United States Patent [19]

Langenbach

[11] 4,030,803

[45] June 21, 1977

[54] ELECTRICAL CONTACT AND RETENTION MEANS THEREFOR

[75] Inventor: Jack E. Langenbach, Newport Beach, Calif.

[73] Assignee: International Telephone and Telegraph Corporation, New York, N.Y.

[22] Filed: Nov. 19, 1975

[21] Appl. No.: 633,431

[52] U.S. Cl. ..... 339/217 S
[51] Int. Cl.[2] ..... H01R 9/06
[58] Field of Search ..... 339/217 S

[56] References Cited

UNITED STATES PATENTS

| | | | |
|---|---|---|---|
| 2,468,368 | 4/1949 | Jackson | 339/217 S X |
| 2,814,024 | 11/1957 | Narozny | 339/217 S X |
| 3,047,832 | 7/1962 | Deakin | 339/217 S |
| 3,048,811 | 8/1962 | Lock | 339/217 S X |
| 3,072,880 | 1/1963 | Olsson | 339/217 S |
| 3,179,969 | 4/1965 | Glynn | 24/214 |

FOREIGN PATENTS OR APPLICATIONS

| | | | |
|---|---|---|---|
| 6,505,028 | 10/1965 | Netherlands | 339/217 S |
| 313,867 | 5/1956 | Switzerland | 339/217 S |

*Primary Examiner*—Gerald A. Dost
*Attorney, Agent, or Firm*—Thomas L. Peterson

[57] ABSTRACT

A male contact and insulator mounting therefor including a conductive stamping having first and second split cylinders formed about the same axis at its opposite ends, the stamping having an oppositely disposed pair of strips connecting the cylinders, both strips being bowed outwardly from each other. The formed conductor is snapped into a rectangular hole extending all the way through an insulator body. The body has shoulders on the narrowest sides against which the external surfaces of the bowed portions of the strips bear respectively on corresponding ones of the shoulders. The outside diameter of the first cylinder, which acts as the male contact or pin, is slightly less than the hole width. The strip width is also slightly smaller than the hole width. The outside diameter of the second cylinder is larger than the hole width and bears against the insulator to act as a stop. The conductor can be released from the insulator by backing it out. This can be done by pressing the strips together with a tool.

5 Claims, 9 Drawing Figures

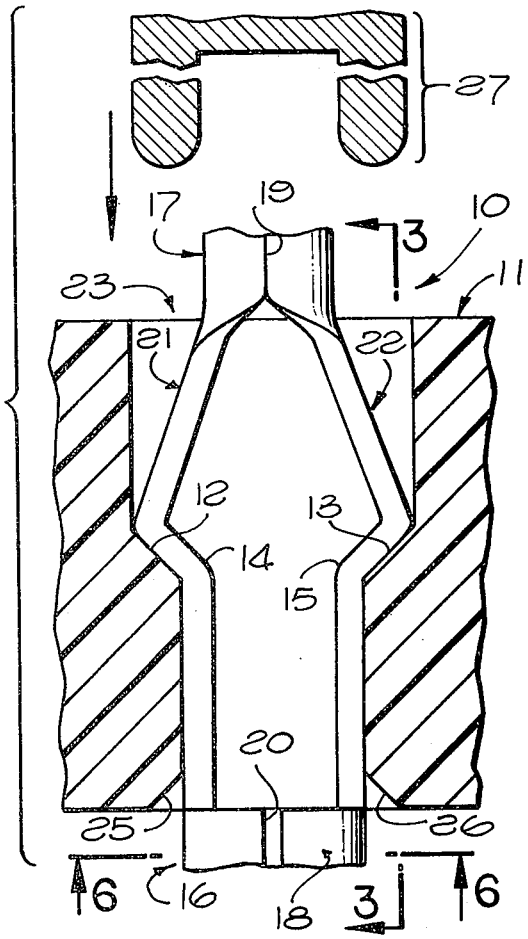
FIG. 1.
FIG. 3.
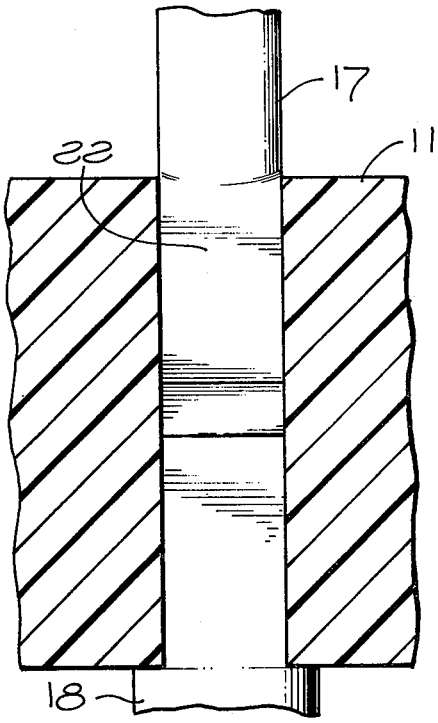
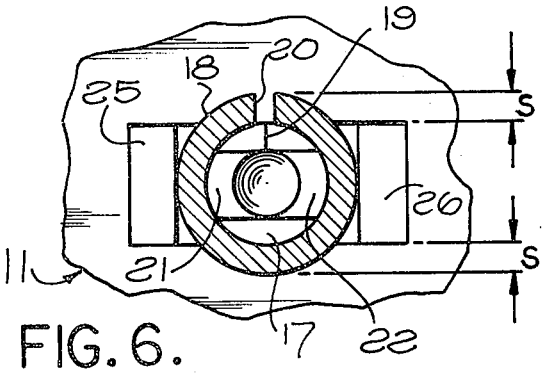
FIG. 6.
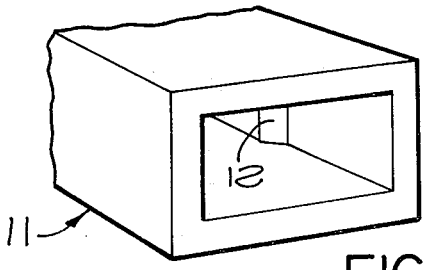
FIG. 4.
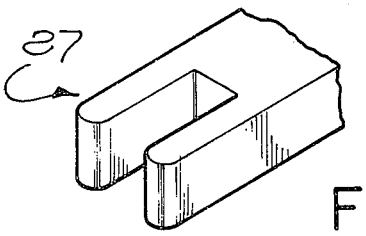
FIG. 2.
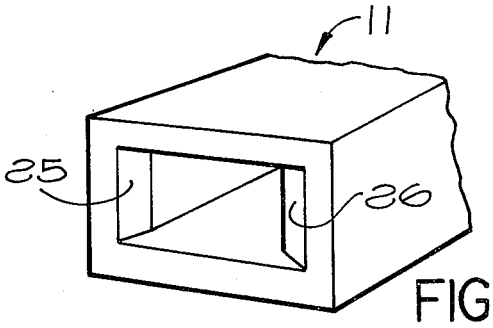
FIG. 5.

ELECTRICAL CONTACT AND RETENTION MEANS THEREFOR

BACKGROUND OF THE INVENTION

This invention relates to electrical connectors, and more particularly to a releasable pin and insulator assembly.

Prior art lanced retention tines and other common means of retaining stamped sheet metal contacts in "hard body" insulators have several serious disadvantages. The tines are small and easily become damaged. Rotation of prior art contacts, the stability thereof, and the large amount of space required therefore are also problems.

Typical of the prior art described in the foregoing is set forth below:

U.S. Pat. Nos.

3,156,516
3,158,424
3,212,052
3,299,244
3,245,030
3,355,704
3,474,398
3,588,789

SUMMARY OF THE INVENTION

In accordance with the device of the present invention, the above-described and other disadvantages of the prior art are overcome by providing a "tineless" contact in which the sides of the contact body themselves are formed to act as beams supported at both ends with a load concentrated at the center.

The above-described and other advantages of the present invention will be better understood from the following detailed description when considered in connection with the accompanying drawings.

BRIEF DESCRIPTION OF THE DRAWINGS

In the drawings which are to be regarded as merely illustrative:

FIG. 1 is a broken away vertical sectional view, partly in elevation, of an electrical connector assembly;

FIG. 2 is a perspective view of a tool which may be employed to disassemble the arrangement shown in FIG. 1;

FIG. 3 is a broken away vertical sectional view, partly in elevation, of the connector assembly taken on the line 3—3 shown in FIG. 1;

FIG. 4 is a perspective view of a portion of an insulator shown in FIGS. 1 and 3;

FIG. 5 is another perspective view of the insulator shown to FIGS. 1 and 3;

FIG. 6 is a bottom plan view, partly in section, taken on the line 6—6 of the connector assembly shown in FIG. 1;

DESCRIPTION OF THE PREFERRED EMBODIMENT

Figure 7:
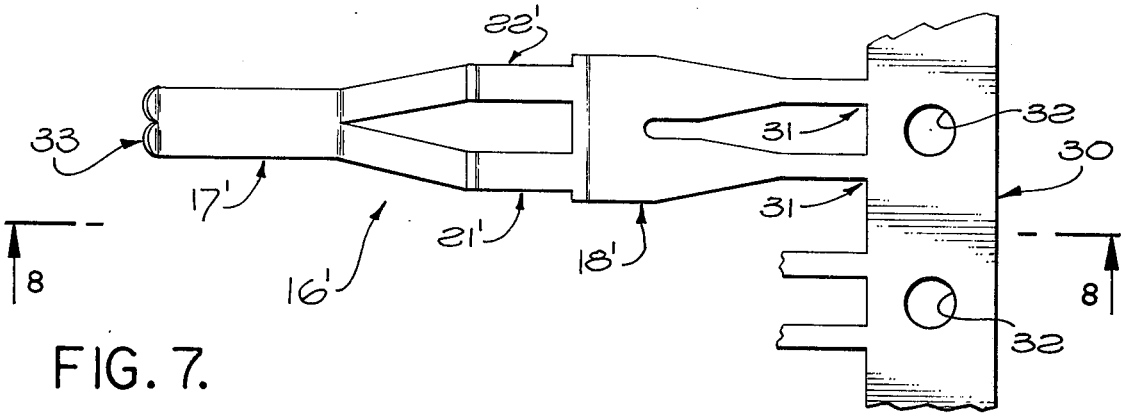
FIG. 7 is a top plan view of a metal stamping assembly which, when suitably formed, is employed in the assembly of FIGS. 1, 3 and 6.

A connector assembly constructed in accordance with the present invention is illustrated at 10 in FIG. 1 including an insulator body 11 having shoulders 12 and 13 against which bent portions 14 and 15, respectively, of a formed metal stamping 16 bear. Stamping 16 has upper and lower cylinders 17 and 18, respectively, which are split at 19 and 20, respectively. Cylinders 17 and 18 are integral with and form an isotropic body with leaf springs 21 and 22 that have bent portions 14 and 15, respectively.

Insulator body 11 has an approximately rectangular hole 23 therethrough which is longer at the upper end thereof than at the lower end thereof because of the shoulders 12 and 13, the length of the hole section being otherwise constant. The width of the hole section is constant as shown in FIG. 3.

Cylinder 17 forms a mating contact or pin for any conventional socket.

Formed conductive stamping 16 may be inserted into insulator hole 23 from a position external thereof upwardly, as viewed in FIG. 1, until portions 14 and 15 of leaf springs or strips 21 and 22 snap onto shoulders 12 and 13. In this position, cylinder 18 abuts insulator 11 and acts as a stop as shown in FIG. 3. Strip portions 14 and 15 may be located in a manner such that cylinder 18 is held in firm abutment with insulator 11 and shown in FIG. 3.

As shown in FIG. 1, insulator 11 has beveled edges 25 and 26 at the lower end of hole 23. In order to remove formed stamping 16 from insulator 11, a tool 27 shown in FIGS. 1 and 2 may be lowered to press strips 21 and 22 together, whereby formed stamping 16 may be pressed out of hole 23 downwardly as viewed in FIG. 1.

Preferably, cylinders 18 and 17 are fabricated in successive steps between successive different pairs of dies. Alternatively, cylinders 18 and 17 may be rolled upon respective mandrels of larger and smaller diameters, respectively, but which have concentric external cylindrical surfaces. Strip portions 14 and 15 may or may not be formed independently, if desired.

As viewed in FIG. 1, hole 23 has upper and lower ends which are shown in perspective views in FIGS. 4 and 5, respectively.

In FIG. 6, a bottom plan view of the structure shown in FIG. 1 is illustrated partly in section. Note will be taken that portions S of cylinder 18 rest upon the bottom of insulator 11. These portions thus help retain formed stamping 16 inside hole 23 with strip portions 14 and 15 bearing upon shoulders 12 and 13, respectively.

A stamping assembly 16′ is shown in FIG. 7 from which forme stamping 16 may be made. Stamping assembly 16′ contains a portion 18′ which is formed into cylinder 18, strips 21′ and 22′ which are formed into strips 21 and 22, respectively, and a portion 17′ which is formed into the cylinder 17.

Figure 9:
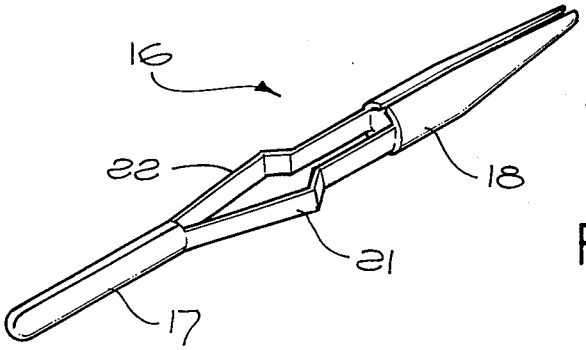
FIG. 9 is a perspective view of a form stamping fabricated from the assembly shown in FIGS. 7 and 8.

A perspective view of the formed stamping 16 is shown in FIG. 9.

Because portion 17′ is formed into cylinder or pin 17, cylinder 18 is therefore, for example, connected to a wire or to an electrical conductor.

In FIG. 7, assembly 16′ includes a strip 30 from which formed stampings 16 are severed at 31. Strip 30 has holes 32 therethrough.

Figure 8:
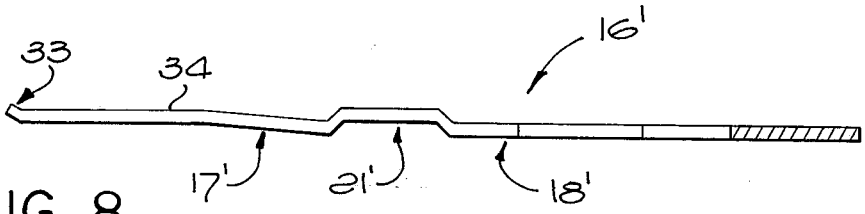
FIG. 8 is a side elevational view, partly in section, taken on the line 8—8 of the stamping assembly shown in FIG. 7.

Although the initial stamping of assembly 16′ may be perfectly flat, it also may be as shown in FIGS. 7 and 8.

In FIGs. 7 and 8, the left end of the stamping assembly 16′ is split, curved and bent upwardly at 33 as viewed in FIG. 8. Portion 34 (FIG. 8) extends, very slightly, upwardly to the left. Portions 21′ and 22′ extend horizontally, more or less, but downwardly in an offset manner at their left and right ends where they connect with portions 17′ and 18′, respectively. Portion 18′ and strip 30 are flat and horizontal, and lie between the same two flat parallel planes.

The stamping assembly 16′ of FIGS. 7 and 8 may be rolled or otherwise further formed to the shape shown in FIG. 9 from the shape shown in FIGS. 7 and 8.

What is claimed is:

1. An electrical contact assembly comprising: an insulator body having a hole extending completely through the thickness thereof, and a shoulder on each of two opposite sides of said hole extending toward each other, said hole having different but rectangular cross sections at both of first and second opposite ends thereof, said hole having one cross sectional dimension wider at said first end than the corresponding one at said second end because of said shoulders, and a second dimension uniform throughout the thickness of said insulator body; first means in said hole having a leaf spring for each of said shoulders and a bend in each to snap onto and to seat on said shoulders when said leaf springs are slidably inserted into said hole; and second means connected to both of said leaf springs adjacent said second hole end to abut the external surface of said insulator body and to act as a stop when said leaf springs are seated as aforesaid, said second means including a first cylinder having an outside diameter greater than said second dimension, a portion of one end of said cylinder abutting said insulator external surface, a contact being fixed to both ends of said leaf springs that are positioned at said hole first end.

2. The invention as defined in claim 1, wherein said contact is a male contact.

3. The invention as defined in claim 2, wherein both of said leaf springs and both of said means are all integral with one another, and made of a formed, unbonded, and isotropic stamping, said first cylinder having a first axial slot extending completely therethrough in both axial and radial directions, said contact likewise including a second cylinder coaxial with said first cylinder, and having a second axial slot in the plane of and at the same angular position of said first slot extending completely through said second cylinder in both axial and radial directions.

4. The invention as defined in claim 1, wherein both of said leaf springs and both of said means are all integral with one another, and made of a formed, unbonded, and isotropic stamping, said first cylinder having a first axial slot extending completely therethrough in both axial and radial directions, said contact likewise including a second cylinder coaxial with said first cylinder and having a second axial slot in the plane of and at the same angular position of said first slot extending completely through said second cylinder in both axial and radial directions.

5. An electrical contact assembly comprising: an insulator body having a hole extending completely through the thickness thereof, and a shoulder on each of two opposite sides of said hole extending toward each other, said hole having different but rectangular cross sections at both of first and second opposite ends thereof, said hole having one cross sectional dimension wider at said first end than the corresponding one at said second end because of said shoulders, and a second dimension uniform throughout the thickness of said insulator body; first means in said hole having a leaf spring for each of said shoulders and a bend in each to snap onto and to seat on said shoulders when said leaf springs are slidably inserted into said hole; and second means connected to both of said leaf springs adjacent said second hole end to abut the external surface of said insulator body and to act as a stop when said leaf springs are seated as aforesaid, said second means including a first cylinder having an outside diameter greater than said second dimension, a portion of one end of said cylinder abutting said insulator external surface, both of said leaf springs and both of said means being all integral with one another, and made of a formed, unbonded, and isotropic stamping, said first cylinder having a first axial slot extending completely therethrough in both axial and radial directions.

* * * * *